US008778164B2

(12) United States Patent
Piascik et al.

(10) Patent No.: US 8,778,164 B2
(45) Date of Patent: Jul. 15, 2014

(54) METHODS FOR PRODUCING A HIGH TEMPERATURE OXIDATION RESISTANT COATING ON SUPERALLOY SUBSTRATES AND THE COATED SUPERALLOY SUBSTRATES THEREBY PRODUCED

(75) Inventors: James Piascik, Randolph, NJ (US); Derek Raybould, Denville, NJ (US); George Reimer, Simpsonville, SC (US)

(73) Assignee: Honeywell International Inc., Morristown, NJ (US)

( * ) Notice: Subject to any disclaimer, the term of this patent is extended or adjusted under 35 U.S.C. 154(b) by 397 days.

(21) Appl. No.: 12/970,592

(22) Filed: Dec. 16, 2010

(65) Prior Publication Data

US 2012/0156519 A1 Jun. 21, 2012

(51) Int. Cl.

| | |
|---|---|
| ***C25D 3/66*** | (2006.01) |
| ***C25D 5/50*** | (2006.01) |
| ***C25D 7/00*** | (2006.01) |
| ***C23C 28/00*** | (2006.01) |

(52) U.S. Cl.
USPC ..... 205/228; 205/170; 205/176; 205/195; 205/223; 205/231; 205/232; 205/233

(58) Field of Classification Search
USPC ..... 205/228, 233
See application file for complete search history.

(56) References Cited

U.S. PATENT DOCUMENTS

| | | | | |
|---|---|---|---|---|
| 3,607,413 | A * | 9/1971 | Buzzelli | 205/231 |
| 4,123,594 | A | 10/1978 | Chang | |
| 4,789,441 | A | 12/1988 | Foster et al. | |
| 4,810,334 | A | 3/1989 | Honey et al. | |
| 5,037,513 | A | 8/1991 | Foster | |
| 5,856,027 | A | 1/1999 | Murphy | |
| 6,113,770 | A * | 9/2000 | Rasmussen | 205/108 |
| 6,123,997 | A | 9/2000 | Schaeffer et al. | |
| 6,291,014 | B1 | 9/2001 | Warnes et al. | |
| 6,695,960 | B1 | 2/2004 | Bacos et al. | |
| 6,974,636 | B2 | 12/2005 | Darolia et al. | |

(Continued)

FOREIGN PATENT DOCUMENTS

| | | | |
|---|---|---|---|
| CN | 101914792 | A | 12/2010 |
| CN | 102041532 | A | 5/2011 |

(Continued)

OTHER PUBLICATIONS

F. A. Lowenheim, Electroplating, McGraw-Hill Book Company, New York, 1978, pp. 67-81, 99-112.*

(Continued)

*Primary Examiner* — James Lin
*Assistant Examiner* — William Leader
(74) *Attorney, Agent, or Firm* — Ingrassia Fisher & Lorenz, P.C.

(57) ABSTRACT

Methods for producing a high temperature oxidation resistant coating on a superalloy component and the coated superalloy component produced thereby are provided. Aluminum or an aluminum alloy is applied to at least one surface of the superalloy component by electroplating in an ionic liquid aluminum plating bath to form a plated component. The plated component is heat treated at a first temperature of about 600° C. to about 650° C. and then further heat treated at a second temperature of about 700° C. to about 1050° C. for about 0.50 hours to about two hours or at a second temperature of about 750° C. to about 900° C. for about 12 to about 20 hours.

18 Claims, 3 Drawing Sheets

(56) References Cited

U.S. PATENT DOCUMENTS

| | | | | |
|---|---|---|---|---|
| 6,998,151 | B2 | 2/2006 | Grylls et al. | |
| 7,569,131 | B2 * | 8/2009 | Hixon-Goldsmith et al. | 205/102 |
| 2001/0031375 | A1 | 10/2001 | Bugnet et al. | |
| 2002/0132132 | A1 | 9/2002 | Bose et al. | |
| 2003/0211239 | A1 | 11/2003 | Grylls et al. | |
| 2005/0064228 | A1 | 3/2005 | Darolia et al. | |
| 2008/0107805 | A1 | 5/2008 | Palumbo et al. | |
| 2008/0193663 | A1 | 8/2008 | Strangman et al. | |
| 2008/0272004 | A1 | 11/2008 | Roth-Fagaraseanu | |
| 2009/0236227 | A1 | 9/2009 | Kuzmanovic et al. | |
| 2010/0108524 | A1 | 5/2010 | van Mol et al. | |
| 2010/0261034 | A1 | 10/2010 | Cardarelli | |
| 2011/0083967 | A1 * | 4/2011 | Ruan et al. | 205/238 |

FOREIGN PATENT DOCUMENTS

| | | | |
|---|---|---|---|
| EP | 0184985 | A2 | 6/1986 |
| EP | 1533401 | A1 | 5/2005 |
| EP | 1956118 | A2 | 8/2008 |
| EP | 2 330 233 | A1 | 6/2011 |
| JP | 2004035902 | A | 2/2004 |
| JP | 2004035911 | A | 2/2004 |
| WO | 2006036171 | A1 | 4/2006 |
| WO | 2008/127112 | A2 | 10/2008 |
| WO | 2009139833 | A2 | 11/2009 |

OTHER PUBLICATIONS

Abbott, A. P., McKenzie K. J., "Application of ionic liquids to the electrodeposition of metals", Physical Chemistry Chemical Physics (http://pubs.rsc.org), 2006, 8, 4265-4279.

Endes, F., "Ionic Liquids: Solvents for the Electrodeposition of Metals and Semiconductors", Chemphyschem 2002, 3, 144-154.

EP Search Report, 11 193 119.2, dated May 8, 2012.

N'Gandu-Muamba, J. et al. "The Reactive Element Effect (R.E.E.): A Tentative Classification," Journal De Physique IV, Colloque C9, Supplement au Journal de Physique III, vol. 3, Dec. 1993, pp. 281-290.

Von K. Jopp, L. "Aluminiumabscheidung Mit Ionischen Flussigkeiten, Elegant Deposition of Aluminum from Ionic Liquids," Galvanotechnik, Oct. 2009, pp. 2238-2241.

EP Communication, EP 11 193 119.2, dated May 29, 2012.

EP Search Report for EP 13 152 283.1, dated Jul. 5, 2013.

EP Communication, EP 13152283.1-1359 dated Aug. 14, 2013.

* cited by examiner

METHODS FOR PRODUCING A HIGH TEMPERATURE OXIDATION RESISTANT COATING ON SUPERALLOY SUBSTRATES AND THE COATED SUPERALLOY SUBSTRATES THEREBY PRODUCED

TECHNICAL FIELD

The present invention generally relates to protective coatings for superalloy components that are used at high temperatures, and more particularly relates to methods for producing a high temperature oxidation resistant coating on superalloy substrates and the coated superalloy substrates thereby produced.

BACKGROUND

Aerospace components made of superalloys such as nickel and cobalt-based superalloys are susceptible to oxidation, reducing their service life and necessitating their replacement or repair. For example, gas turbine engine components such as, for example, the burner assembly, turbine vanes, nozzles, and blades are susceptible to oxidation because they encounter severe operating conditions at high temperature conditions. As used herein, "severe operating conditions" include high gas velocities and exposure to salt, sulfur, and sand causing hot corrosion or erosion and "high temperature conditions" refers to temperatures of about 700° C. to about 1150° C. The oxidation resistance of such superalloy components can be enhanced by applying protective coatings.

Simple aluminide coatings are used on superalloy components to improve oxidation resistance, especially when cost is an issue. Platinum aluminide coatings are used in even more demanding applications. There are several drawbacks to conventional aluminum deposition techniques. For example, chemical vapor deposition (CVD) is costly and requires using dangerous gases. While deposition using pack cementation is less costly, there are also drawbacks associated with this conventional deposition technique, such as the introduction of impurities into the aluminum, thereby reducing coating life. For both of these gaseous aluminizing processes, the temperatures used are high so that the aluminum diffuses into the superalloy substrate/component as it is deposited such that the surface aluminide is only about 20-30% aluminum. There are lower temperature aluminum CVD deposition processes that do not result in aluminum diffusion, but these processes are only used in a few specialized applications, because of the dangerous gases involved. In addition, as CVD and pack cementation deposition processes are performed at high temperatures, under aggressive deposition conditions, high cost masking techniques prior to deposition are used to ensure that high stress areas of the superalloy component are not coated. After deposition or coating, the masks are removed. High temperature (and high cost) masking techniques include applying masking pastes to the component by spraying or dipping. Extreme care (and labor) has to be taken to ensure that only the desired areas are coated. These pastes form hard deposits that are difficult and labor intensive to remove.

Aluminum electroplating processes may also be used to deposit aluminum at high purity levels, but conventional aluminum electroplating is complex, costly, performed at high temperatures, and/or requires the use of flammable solvents and pyrophoric compounds, which decompose, evaporate and are oxygen-sensitive, necessitating costly specialized equipment and presenting serious safety and environmental challenges to a commercial production facility. In addition, for all aluminum electroplating processes on superalloys, the aluminum is present after plating as an aluminum layer on the surface of the substrate. The aluminum layer needs bonding and diffusion into the superalloy component to produce a high temperature oxidation resistant aluminide coating. As used herein, the term "aluminide coating" refers to the coating after diffusion of aluminum into the superalloy component. If conventional aluminum diffusion temperatures of 1050° C. to 1100° C. are used, undesirable microstructures are created. In addition, as conventional diffusion into a superalloy component causes its embrittlement reducing its life, great care has to be taken to ensure that high stress areas are not coated using high temperature masking techniques as previously described.

Ionic liquids have been used to deposit aluminum on non-superalloy substrates for corrosion and wear and tear resistance in a lab-scale three-step process that includes a first pretreatment step in which the substrate is cleaned, degreased, pickled, and then dried. In the second step, the metal substrate is then electroplated using the ionic liquid at a temperature ranging from 60 to 100° C. The third step includes removing the ionic liquid from the substrate.

It is well established that small additions of the so-called "reactive elements" (R.E.) such as silicon, hafnium, zirconium, cerium, and lanthanum increase the oxidation resistance of high temperature aluminide coatings. Unfortunately, the co-deposition of aluminum and the reactive element is difficult, expensive, and can be dangerous. In a best case scenario, the co-deposit requires at least two separate deposition processes, such as the initial deposit of aluminum by a chemical vapor deposition process, pack cementation process, or the like followed by deposition of the reactive element by another chemical vapor deposition process in the same or a different reactor. A heat-treated slurry coating containing aluminum and hafnium particles has also been used in an attempt to co-deposit aluminum and hafnium to form a protective aluminide-hafnium coating, but the results have been disappointing with the hafnium particles not sufficiently diffusing into the aluminum, the base metal of the coated component oxidizing, and the concentration of the reactive element unable to be controlled.

Accordingly, it is desirable to provide methods for producing a high purity, high temperature oxidation resistant coating on superalloy components, including gas turbine engine components. In addition, it is desirable to provide methods for producing a high temperature oxidation resistant coating on a superalloy component using a simplified, lower cost, safe, and environmentally-friendly method including the use of low temperature masking techniques. Furthermore, other desirable features and characteristics of the present invention will become apparent from the subsequent detailed description of the invention and the appended claims, taken in conjunction with the accompanying drawings and this background of the invention.

BRIEF SUMMARY

Methods are provided for producing a high temperature oxidation resistant coating on a superalloy component. In accordance with one exemplary embodiment, the method comprises applying aluminum or an aluminum alloy to at least one surface of the superalloy component by electroplating in an ionic liquid aluminum plating bath to form a plated component. The plated component is heat treated at a first temperature of about 600 to about 650° C. for about 15 to about 45 minutes and then further heat treated at a second temperature of about 700° C. to about 1050° C. for about 0.50 hours to about two hours or a second temperature of about 750° C. to about 900° C. for about 12 to about 20 hours.

Methods are provided for producing a high temperature oxidation resistant coating on a superalloy component, in accordance with yet another exemplary embodiment of the present invention. The method comprises selecting a superalloy component to be coated. An ionic liquid aluminum plating bath is formed or selected. At least one surface of the superalloy component is electroplated under electroplating conditions in the ionic liquid aluminum plating bath to form a plated component. The plated component is heated to a first temperature in a range of about 600° C. to about 650° C. and held at the first temperature for about 15 minutes to about 45 minutes. The plated component is heated to a second temperature in a range of about 700 to about 1050° C. and held for about 0.50 hours to about two hours or a second temperature in a range of about 750° C. to about 900° C. for about 12 to about 20 hours.

Superalloy components coated with a high temperature oxidation resistant coating are provided, in accordance with yet another exemplary embodiment of the present invention. The coated superalloy component comprises a component comprised of a superalloy material and an aluminide or aluminide alumina alloy coating on the component including an alpha alumina surface layer.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Various embodiments are directed to methods for producing a high purity, high temperature oxidation resistant coating on superalloy components by applying aluminum or an aluminum alloy to at least one surface of the superalloy substrate at a heating temperature at or below 100° C. in an ionic liquid aluminum plating bath comprising an ionic liquid and an aluminum salt. The ionic liquid aluminum plating bath may further comprise a dry salt of a reactive element to co-deposit aluminum and the reactive element (the "aluminum alloy") in a single step and further improve the oxidation resistance of the coating at high temperatures, i.e., temperatures from about 700 to about 1150° C., to extend the life of the superalloy component. The coating may include one layer or multiple layers formed in any sequence. The coating may include, for example, platinum alloyed with aluminum, platinum alloyed with the aluminum alloy, a platinum layer or layers, or a combination thereof. A thermal barrier coating may be used with the high temperature oxidation resistant coating. As used herein, "high purity" means a purity greater than about 99.5%

Figure 1:
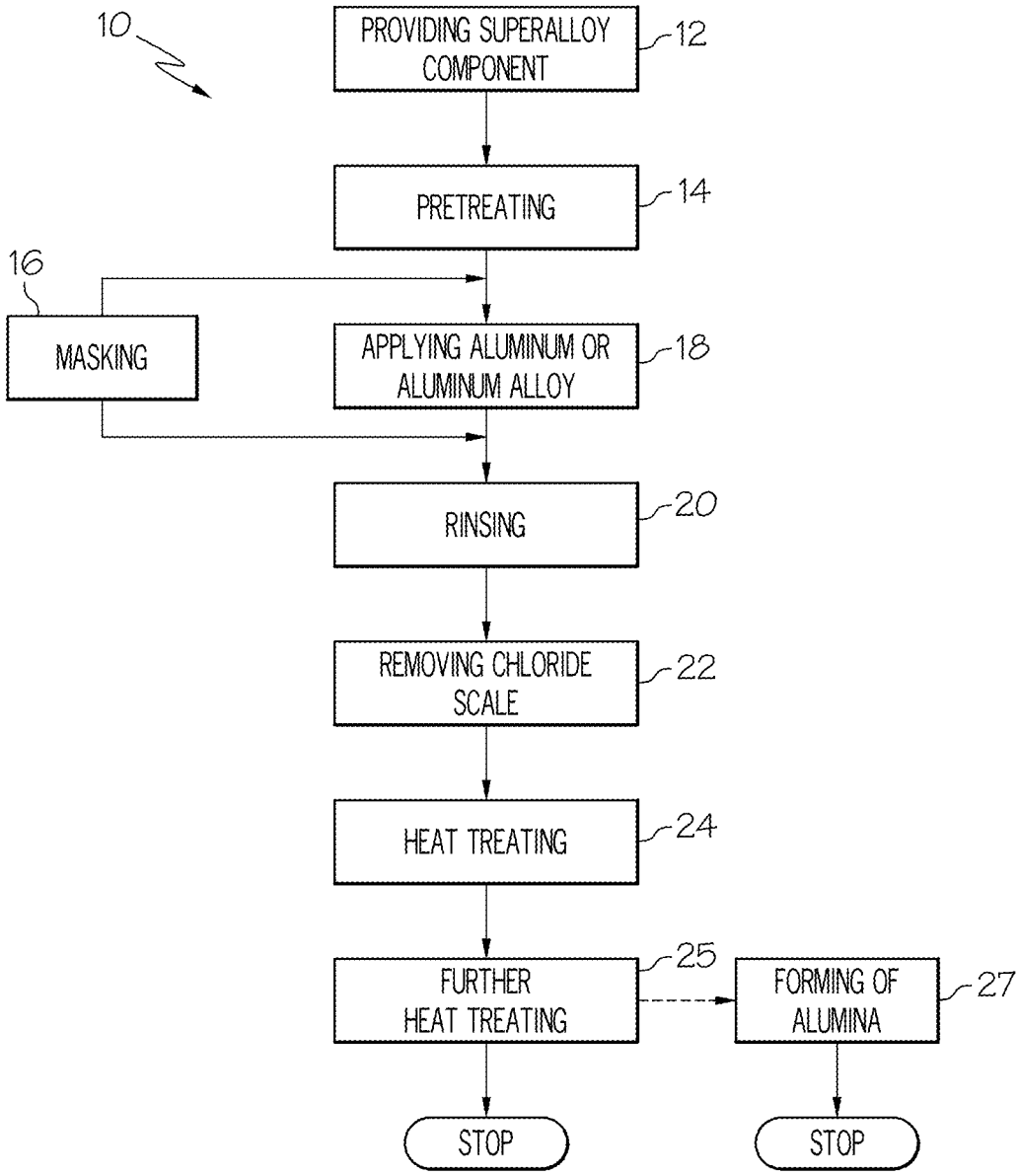
FIG. 1 is a flow diagram of methods for producing a high temperature oxidation resistant coating on superalloy substrates, according to exemplary embodiments of the present invention.
Figure 3:
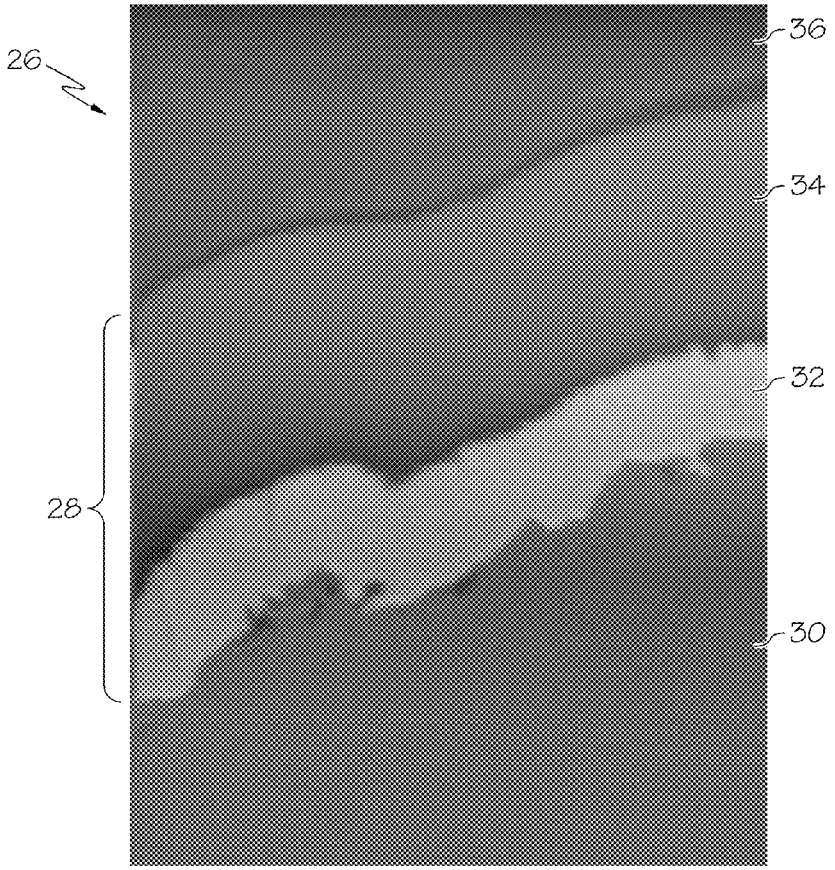
FIG. 3 is a SEM micrograph of a cross-section of a platinum-plated superalloy component coated with an aluminum alloy high temperature oxidation resistant coating produced in accordance with exemplary embodiments.

Referring to FIGS. 1 and 3, a method 10 for producing a high temperature oxidation resistant coating on a superalloy component begins by providing the superalloy component 30 (step 12). The superalloy component comprises a component comprised of a cobalt-based superalloy, a nickel-based superalloy, or a combination thereof. As used herein, the superalloy is the base metal. Suitable exemplary superalloys include, for example, MARM247 and SC180. The surface portions of the superalloy component to be coated are activated by pre-treating to remove any oxide scale on the base metal (step 14). The oxide scale may be removed by, for example, wet blasting with abrasive particles, by chemical treatment, or by other methods as known in the art.

Certain surface portions of the superalloy component are not coated and therefore, these surface portions may be covered (masked) prior to electroplating the superalloy component as hereinafter described and as known in the art. Alternatively or additionally, surface portions where the coating is to be retained may be masked after electroplating followed by etching away the unmasked coating with a selective etchant that will not etch the base metal. Suitable exemplary mask materials include glass or Teflon® non-stick coatings. Suitable exemplary etchants include, for example, KOH, NaOH, LiOH, dilute HCl, $H_2SO_4$, $H_2SO_4/H_3PO_4$, commercial etchants containing $H_3PO_4$, $HNO_3$/acetic acid, or the like. The masking step, whether performed prior to, after, or both prior and after electroplating is referred to as step 16. When the masking step is performed prior to electroplating, the mask material used is compatible with ionic liquids. As the electroplating is performed at relatively low temperatures (less than about 100° C.), low temperature masking techniques may be used. Plastic masking materials such as, for example, a Teflon® non-stick mask are suitable and can be quickly placed on the areas not to be coated either as tape wrapped or as a perform which acts as a glove. Such masks may be relatively quickly applied and quickly removed and can be reused, making such low temperature masking techniques much less expensive and time consuming than conventional high temperature masking techniques.

Still referring to FIG. 1, method 10 continues by applying aluminum, or an aluminum alloy to the activated surface(s) of the superalloy component by electroplating the superalloy component (masked or unmasked) in an ionic liquid aluminum plating bath to form a plated superalloy component (step 18). The ionic liquid aluminum plating bath comprises an aluminum salt dissolved in an ionic liquid. As noted previously, the ionic liquid aluminum plating bath may further comprise a dry salt of a reactive element if the aluminum alloy is to be applied, as hereinafter described. Both salts (aluminum and reactive element) are dissolved in the ionic liquid and both metals are electrochemically deposited from the bath as an alloy. The amount of each salt in the ionic liquid should be such that the bath is liquid at room temperature and that it forms a good deposit as determined, for example, by SEM micrograph. The aluminum salt dissolved in the ionic liquid comprises, for example, Aluminum chloride ($AlCl_3$).

Possible suitable anions other than chloride anions that are soluble in the ionic liquid aluminum plating bath and can be used in the aluminum salt include, for example, acetate, hexafluorophosphate, and tetrafluoroborate anions as determined by the quality of the deposit. Suitable exemplary ionic liquids are commercially available from, for example, BASF Corporation, Rhineland-Palatinate, Germany and include 1-ethyl-3-methylimidazolium chloride (also known as EMIM Cl), 1-ethyl-3-methylimidazolium bis(trifluoromethyl-sulfonyl)amide (also known as [EMIM] $Tf_2N$), 1-butyl-1-1-methylpyrrolidinium bis(trifluoromethyl sulfonyl)amide (also known as [BMP] $Tf_2N$), 1-butyl-1-methyl-pyrrolidinium bis(trifluoromethylsulfonyl)amide (also known as [Py(1,4)]Tf(2)N), and combinations thereof. As used herein, the term "ionic liquid" refers to salts that are liquid at low temperatures (typically below 100° C.) due to their chemical structure, comprised of mostly voluminous, organic cations and a wide range of ions. They do not contain any other non-ionic components like organic solvent or water. Ionic liquids are not flammable or pyrophoric and have low or no vapor pressure, and therefore do not evaporate or cause emissions. An exemplary ionic liquid aluminum plating bath comprising 1-ethyl-3-methylimidazolium chloride (EMIM Cl) and $AlCl_3$ is available commercially from BASF Corporation, and marketed under the trade name BASF Basionics™ Al03. Other suitable ionic liquid aluminum plating baths may be commercially available or prepared using separately available ionic liquids and aluminum salts. For example, an ionic liquid aluminum plating bath of EMIM-Cl and $AlCl_3$ in a molar ratio of 1.0 to 1.5 has the following weight percentages of ionic liquid (EMIM Cl) and aluminum salt ($AlCl_3$): 42.3 wt % EMIM Cl and 57.7 wt % $AlCl_3$. The weight percentage of $AlCl_3$ in EMIM-Cl ionic liquid may vary +/−25%, i.e., 43 to 72 wt % in the above example.

As noted previously, in an embodiment, the ionic liquid aluminum plating bath may further comprise a dry salt of a "reactive element". "Reactive elements" include silicon (Si), hafnium (Hf), zirconium (Zr), cesium (Cs), lanthanum (La), yttrium (Y), tantalum (Ta), titanium (Ti), rhenium (Re), or combinations thereof. The dry salt of the reactive element comprises dry hafnium salts, for example, anhydrous hafnium chloride ($HfCl_4$), dry silicon salts, for example, anhydrous silicon chloride, dry zirconium salts, for example, anhydrous Zirconium (IV) chloride ($ZrCl_4$), dry cesium salts, dry lanthanum salts, dry yttrium salts, dry tantalum salts, dry titanium salts, dry rhenium salts, or combinations thereof "Dry salts" are substantially liquid/moisture-free. The salt of the reactive element is preferably in a +4 valence state because of its solubility in the ionic liquid aluminum plating bath, however other valance states may be used if the desired solubility is present. While chloride salts have been described, it is to be understood that other reactive element salts may be used such as, for example, reactive element salts of acetate, hexafluorophosphate, and tetrafluoroborate anions. The anion of the reactive element salt may be different or the same as the anion of the aluminum salt. Reactive elements have the potential to spontaneously combust and react with water. By alloying the reactive element salt with aluminum in the ionic liquid aluminum plating bath in a single electroplating step in accordance with exemplary embodiments, the reactivity of the reactive element and their susceptibility to oxidation is decreased, thereby making deposition simpler and safer than conventional two step deposition processes. The concentration of reactive element in the deposit comprises about 0.05 wt % to about 10 wt % (i.e., the ratio of reactive element to aluminum throughout the deposit, no matter the number of layers, desirably remains constant). In the ionic liquid aluminum plating bath, the concentration of hafnium chloride comprises about 0.001 wt % to about 5 wt %, preferably about 0.0025 to about 0.100 wt %. This preferred range is for a single layer. Multiple layers with thin hafnium concentrated layers would require higher bath concentrations of $HfCl_4$. A similar concentration range of reactive element salts other than hafnium chloride in the ionic liquid aluminum plating bath may be used.

The step of applying aluminum or the aluminum alloy is performed at electroplating conditions as hereinafter described, and may be performed in ambient air (i.e., in the presence of oxygen). It is preferred that the electroplating be performed in a substantially moisture-free environment. The ionic liquid aluminum plating bath remains stable up to a water content of 0.1 percent by weight. At higher water content, electrodeposition of aluminum ceases, chloroaluminates are formed, water electrolyzes into hydrogen and oxygen, and the bath forms undesirable compounds and vapors. A commercial electroplating tank or other vessel equipped with a cover and a purge gas supply as known in the art may be used to form positive pressure to substantially prevent the moisture from the air getting into the ionic liquid aluminum plating bath. Suitable exemplary purge gas may be nitrogen or other inert gas, dry air, or the like. The aluminum or aluminum alloy layer is formed on the superalloy component(s) using the ionic liquid aluminum plating bath with one or more aluminum anodes and the superalloy component(s) to be coated (i.e., plated) as cathode. A pure reactive element anode may be used to replenish the reactive element fraction, the aluminum being replenished continuously through the aluminum anode. Suitable electroplating conditions are known to one skilled in the art and vary depending on the desired thickness of the electroplated layer(s) or coating. The total thickness of the coating is about 15 to about 45 microns. The aluminum or aluminum alloy may be applied directly on the superalloy component to form the aluminum or aluminum alloy layer. For example, the time and current density are dependent on each other, i.e., if the plating time is increased, the current density may be decreased and vice versa. Current density is essentially the rate at which the deposit forms. For example, if the current density is doubled, the time is cut in half. In order to produce clear bright deposits, the current density may have to increase as the reactive element concentration increases. Suitable electroplating temperatures range between about 70° to about 100° C., preferably about 90° C. to about 95° C. with a potential of about 0.05 volts to about 1.50 volts.

Elemental precious metals such as, for example, platinum may also be included in the ionic liquid aluminum plating bath to form, respectively, a platinum-aluminum layer or a platinum-aluminum alloy layer. Alternatively or additionally, a platinum layer may be applied to the surface of the superalloy component prior to applying the aluminum or aluminum alloy to at least one surface of the superalloy component and the all layers thermally diffused into the superalloy component in another operation to form a platinum aluminide coating, as hereinafter described. Alternatively, an initial platinum layer may be diffused into the superalloy component prior to electroplating of the aluminum or aluminum alloy. A platinum layer may also or alternatively be used over the aluminum or aluminum alloy. The presence of platinum in the coating, either as a separate layer or alloyed with aluminum (with and without a reactive element) increases the high temperature oxidation resistance of the coating over a coating not containing platinum. Chromium (Cr) could also be beneficially plated with the Al alloy or as a separate layer to improve corrosion resistance.

After removal of the plated superalloy component from the ionic liquid aluminum plating bath, the plated superalloy component is rinsed with a solvent such as acetone, alcohol, or a combination thereof (step 20). As ionic liquids are water-reactive as described previously, it is preferred that the plated superalloy component be rinsed with at least one acetone rinse to substantially remove the water-reactive species in the ionic liquid before rinsing the plated superalloy component with at least one water rinse. The plated superalloy component may then be dried, for example, by blow drying or the like. It is difficult to remove all the chlorides during such rinsing step, and while not wishing to be bound by any particular theory, it is believed that residual chloride may remain on the surface of the plated superalloy component trapped under aluminum oxide (alumina or $Al_2O_3$) scale formed on the surface of the plated superalloy component. Performance of the coated superalloy component may suffer if the scale and residual chloride (hereinafter collectively referred to as "chloride scale") are not substantially removed.

Referring again to FIG. 1, in accordance with an exemplary alternative embodiment, method 10 continues by substantially removing the chloride scale from the surface of the plated superalloy component (step 22). The chloride scale may be removed by an alkaline rinse, an acid rinse using, for example, mineral acids such as HCl, $H_2SO_4$, or organic acids such as citric or acetic acid, or by an abrasive wet rinse because the plating is non-porous. The alkaline rinse may be an alkaline cleaner, or a caustic such as sodium hydroxide, potassium hydroxide, or the like. A desired pH of the alkaline rinse is from about 10 to about 14. The abrasive wet rinse comprises a water jet containing abrasive particles. Both the alkaline rinse and the abrasive wet rinse etch away the chloride scale and a very thin layer of the plating without etching the base metal of the superalloy component. For example, about 0.1 microns of the plating may be etched away. After removal of the chloride scale, the plated superalloy component may be rinsed with at least one water rinse and then dried, for example, by blow drying or the like or using a solvent dip such as, for example, 2-propanol or ethanol to dry more rapidly.

Method 10 continues by heat treating the plated superalloy component in a first heating step at a first temperature less than about 1050° C., preferably about 600° C. to about 650° C. and held for about 15 to about 45 minutes (step 24) and then further heating at a second temperature of about 700° C. to 1050° C. for about 0.50 hours to about two hours (step 25). The second heating step causes diffusion of the aluminum or aluminum alloy into the superalloy component. Heat treatment may be performed in any conventional manner. At the relatively low temperatures of the first and second heating steps, the coating materials do not diffuse as deeply into the superalloy component as with conventional diffusion temperatures, thereby reducing embrittlement of the superalloy component. Thus, the mechanical properties of the coating are improved. However, at such temperatures, alpha alumina, which increases the oxidation resistance of the base metal as compared to other types of aluminas, may not be formed as the surface oxide. Therefore, an optional third heat treatment at about 1000° C. to about 1050° C. for about 5 to about 45 minutes may be desired in order to substantially ensure formation of an alpha alumina oxide layer in the coating. The third heat treatment may be performed, for example, in a separate furnace operation. Alternatively, other techniques to form the alpha alumina surface layer after the first and second heat treatments may be used including, for example, formation of high purity alpha alumina by, for example, a CVD process or a sol gel type process as known in the art.

In accordance with another exemplary embodiment, the plated superalloy component is heat treated in the first heating step followed by further heating at a second temperature of about 750° C. to about 900° C. and holding for a longer residence time of about 12 to about 20 hours to diffuse aluminum into the superalloy component forming the alpha alumina (or alpha alumina alloy) surface layer (step 27). Costs are reduced by avoiding additional heating in a separate furnace operation or using other techniques to form the alpha alumina surface layer. In addition, a separate aging step as known in the art is rendered unnecessary.

The high purity, high temperature oxidation resistant coating produced in accordance with exemplary embodiments may be comprised of one or more layers, formed in any sequence, and having varying concentrations of reactive elements, if any. For example, a ternary deposit of aluminum, and two reactive elements may be performed by electroplating in an ionic liquid aluminum plating bath that includes two dry reactive element salts in addition to the ionic liquid and the aluminum salt. A binary deposit could be performed more than once. For example, the superalloy component may be electroplated in an ionic liquid aluminum plating bath containing, for example, a dry hafnium salt to form an aluminum-hafnium layer followed by another dip in an ionic liquid aluminum plating bath containing, for example, a dry silicon salt to form an aluminum-silicon layer. The rinsing and heating steps may optionally be performed between dips. A pure aluminum layer may be deposited over and/or under an aluminum alloy layer having a concentration of about 0.5 wt % to about 10 wt % of the reactive element or the reactive element may be distributed throughout an aluminum layer. Several elements may be deposited simultaneously by including their dry salts in the ionic liquid aluminum plating bath. For example, hafnium and silicon salts at low concentrations may be introduced into the ionic liquid aluminum plating bath or alternatively, a hafnium-aluminum layer deposited, then a silicon-aluminum layer, and then a pure aluminum layer formed. While the pure aluminum layer is described as the uppermost layer, it is to be understood that the layers may be formed in any sequence.

The high temperature oxidation resistant coating of the present invention may be used with a thermal barrier coating (TBC). For example, the high temperature oxidation resistant coating may be used as an intermediate coat between the superalloy component and the thermal barrier coating. There may also be additional intermediate coats between the superalloy component and the thermal barrier coating. The oxidation resistant coating may be used on new and repaired and overhauled turbine engine components.

EXAMPLES

The following examples were prepared according to the steps described above. The examples are provided for illustration purposes only, and are not meant to limit the various embodiments of the present invention in any way. The coatings produced in accordance with these examples were analyzed by scanning electron micrography (SEM).

Example 1

A 1 inch×1 inch square of a pure nickel substrate was electroplated using an ionic liquid aluminum plating bath of 400 grams BASF AL03 and 0.05 grams of anhydrous $HfCl_4$. Electroplating conditions included the following:

Current density=13.1 amps/ft$^2$ (ASF)

Time=75 minutes

Temperature=90.0 to 90.6° C.

Potential=1.05 volts

Figure 2:
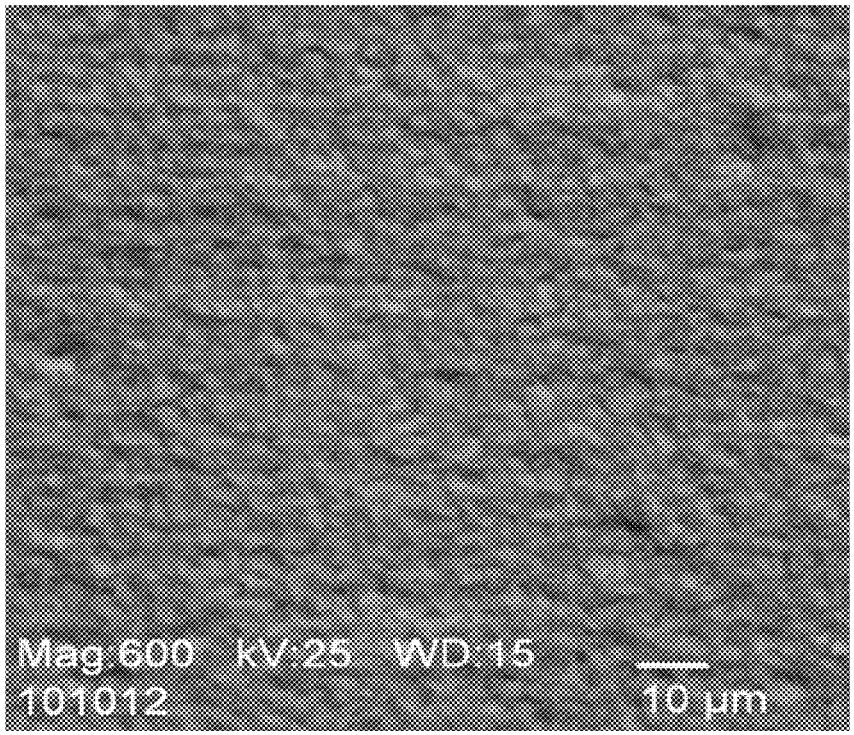
FIG. 2 is a SEM micrograph (600× magnified) of the top surface of a high temperature oxidation resistant coating produced in accordance with exemplary embodiments.

The electroplated sample was rinsed, the chloride scale removed, and then was heat treated at 625° C. for 15 minutes followed by further heat treating at 750° C. for one hour. The Al/Hf alloy coating on the pure nickel substrate electroplated at a current density of 13.1 ASF has a uniform surface appearance as shown in the SEM micrograph of FIG. 2. The composition of the Al/Hf coating prepared in this example is shown below in Table 1:

TABLE 1

| Elements: | WT % |
|---|---|
| Oxygen | 0.15 |
| Aluminum | 73.9 |
| Nickel | 2.2 |
| Hafnium | 23.24 |

Example 2

A platinum plated SC-180 superalloy substrate was electroplated using an ionic liquid aluminum plating bath comprising 400 grams BASF AL03 and 2.5 grams anhydrous $ZrCl_4$. The electroplating conditions included the following:

Current density=7.3 amps/$ft^2$

Duration=60 minutes

Bath Temperature=92° C.

Bath Voltage/Potential=0.48 volts

The electroplated sample was rinsed, the chloride scale removed, and then was heat treated at 625° C. for 15 minutes followed by further heat treating at 750° C. for one hour. The SEM of the cross section of the coated superalloy component 26 is shown in FIG. 3. The coating 28 comprises an aluminum alloy layer 34 (aluminum and the reactive element zirconium) and an underlying platinum layer 32 on the superalloy component 30. A plastic mounting compound 36 used to hold the sample while being polish is also shown. The low oxygen, and aluminum and zirconium content of the aluminum alloy (Al/Zr) coating measured in the sample zone marked with an X is shown in the following TABLE 2:

TABLE 2

| Elements: | WT % |
|---|---|
| Oxygen | 0.27 |
| Aluminum | 32.95 |
| Zirconium | 67 |

The low oxygen concentration of the Example 1 and 2 coatings indicates little or no oxidation of the coating.

From the foregoing, it is to be appreciated that the methods for producing a high purity, dense high temperature oxidation resistant coating on a superalloy substrate are simplified, low cost, and environmentally friendly. The aluminum and reactive element are able to be applied in a single deposition step and low temperature masking techniques can be used. The oxidation resistant coating extends the life of the coated superalloy component produced from such methods.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for producing a high temperature oxidation resistant coating on a superalloy component, the method comprising the steps of:

applying aluminum or an aluminum alloy to at least one surface of the superalloy component by electroplating at electroplating conditions in an ionic liquid aluminum plating bath forming a plated component, the ionic liquid aluminum plating bath comprising an ionic liquid having a melting point less than 100° C. and an aluminum salt; and heat treating the plated component in a first heating step at a first temperature of 600 to 650° C. for about 15 to about 45 minutes and then further heat treating the plated component in a second heating step at a second temperature of 700° C. to 1050° C. for about 0.50 hours to about two hours or 750° C. to 900° C. for about 12 to about 20 hours.

2. The method of claim 1, wherein the step of applying an aluminum alloy comprises electroplating in the ionic liquid aluminum plating bath comprising the ionic liquid, the aluminum salt, and a dry salt of a reactive element, the reactive element selected from the group consisting of hafnium, zirconium, cesium, lanthanum, silicon, rhenium, yttrium, tantalum, titanium, and combinations thereof.

3. The method of claim 2, wherein the reactive element comprises about 0.05% to about 10 wt % of the high temperature oxidation resistant coating.

4. The method of claim 2, wherein the dry salt of the reactive element is selected from the group consisting of hafnium chloride, zirconium chloride, cesium chloride, lanthanum chloride, silicon chloride, rhenium chloride, yttrium chloride, tantalum chloride, titanium chloride, and combinations thereof.

5. The method of claim 1, further comprising the step of forming an alpha alumina oxide layer on the surface of the plated component.

6. The method of claim 5, wherein the step of forming an alpha alumina oxide layer comprises heating treating the plated component in a third heat treating step in a separate furnace at a third temperature of 1000° C. to 1050° C. for about 5 to about 45 minutes after the further heat treating step at a second temperature of 700° C. to 1050° C. for about 0.50 hours to about two hours.

7. The method of claim 1, wherein the ionic liquid aluminum plating bath includes one of a chloride ion or salt that forms a chloride scale on the plated component, the method further comprising the step of substantially removing the chloride scale after the applying step and before the first and second heating steps, the substantially removing step comprising rinsing with a solvent, rinsing with an alkaline or acidic solution, abrasion, or water jet with abrasive particles, or a combination thereof.

8. The method of claim 1, further comprising the step of depositing a precious metal on the superalloy component prior to, after, during, or a combination thereof, the step of applying aluminum or an aluminum alloy.

9. The method of claim 8, wherein the step of depositing a precious metal on the superalloy component during the step of applying aluminum or an aluminum alloy comprises adding an anhydrous salt of the precious metal to the ionic liquid aluminum plating bath.

10. The method of claim 9, further comprising forming a thermal barrier coating over the plated component.

11. The method of claim 9, further comprising the step of depositing chromium on the superalloy component prior to or during the applying step.

12. A method for producing a high temperature oxidation resistant coating on a superalloy component, the method comprising the steps of:

selecting the superalloy component to be coated;

forming or selecting an ionic liquid aluminum plating bath comprising an ionic liquid having a melting point less than 100° C. and an aluminum salt;

electroplating at least one surface of the superalloy component under electroplating conditions in the ionic liquid aluminum plating bath to form a plated component;

heating the plated component in a first heat treating step to a first temperature in a first temperature range of 600° C. to 650° C. and holding at the first temperature for about 15 minutes to about 45 minutes; and then heating the plated component in a second heat treating step to a second temperature in a second temperature range of 700° C. to 1050° C. for about 0.50 hours to about two hours or in a second temperature range of 750° C. to 900° C. for about 12 to about 20 hours.

13. The method of claim 12, wherein the step of forming or selecting an ionic liquid aluminum plating bath further comprises adding a salt of a reactive element to the ionic liquid and the aluminum salt, the reactive element selected from the group consisting of hafnium, zirconium, cesium, lanthanum, silicon, rhenium, yttrium, tantalum, titanium, and combinations thereof, the reactive element comprising about 0.05% to about 10 wt % of the high temperature oxidation resistant coating.

14. The method of claim 12, further comprising the step of forming an alpha alumina oxide layer on the surface of the plated component after heating the plated component in the second heat treating step to the second temperature in the second temperature range of 700° C. to 1050° C. for about 0.50 hours to about two hours.

15. The method of claim 12, wherein the ionic liquid aluminum plating bath includes one of a chloride ion or salt that forms a chloride scale on the plated component, the method further comprising the step of substantially removing the chloride scale after the electroplating step and before the first and second heat treating steps, the substantially removing step comprising rinsing with a solvent, rinsing with an alkaline or acid solution, abrasion, or water jet with abrasive particles, or a combination thereof.

16. The method of claim 12, further comprising the step of depositing a precious metal on the superalloy component prior to, after, during, or a combination thereof, the step of electroplating at least one surface of the superalloy component.

17. A method for producing a high temperature oxidation resistant coating on a superalloy component, the method comprising the steps of:

applying aluminum or an aluminum alloy to at least one surface of the superalloy component by electroplating at electroplating conditions in an ionic liquid aluminum plating bath comprising an ionic liquid that has a melting temperature less than 100° C. and an aluminum salt, the ionic liquid aluminum plating bath including a chloride, thereby forming a plated component with a chloride scale resulting from the chloride in the ionic liquid aluminum plating bath;

substantially removing the chloride scale from the plated component; and then heat treating the plated component in a first heat treating step at a first temperature of 600 to 650° C. for about 15 to about 45 minutes and then further heat treating the plated component in a second heat treating step at a second temperature of 700° C. to 1050° C. for about 0.50 hours to about two hours or 750° C. to 900° C. for about 12 to about 20 hours.

18. The method of claim 17, wherein the removing step comprises rinsing the plated component with the chloride scale with a solvent, rinsing with an alkaline or acidic solution, abrasion, or water jet with abrasive particles, or a combination thereof.

* * * * *